US005286035A

United States Patent [19]

Ward

[11] Patent Number: 5,286,035

[45] Date of Patent: Feb. 15, 1994

[54] ARCHERY HUNTING ARROWHEAD

[76] Inventor: Dennis R. Ward, 807 Mesa Ave., Willcox, Ariz. 85643

[21] Appl. No.: 24,424

[22] Filed: Mar. 1, 1993

[51] Int. Cl.[5] ..... F42B 6/08

[52] U.S. Cl. ..... 273/422

[58] Field of Search ..... 273/416, 419–422

[56] References Cited

U.S. PATENT DOCUMENTS

| | | | |
|---|---|---|---|
| 3,000,635 | 9/1961 | Nieman | 273/421 |
| 3,618,948 | 11/1971 | McGlocklin | 273/421 |
| 4,940,246 | 7/1990 | Stagg | 273/421 |
| 5,044,640 | 9/1991 | Del Monte et al. | 273/422 |
| 5,102,147 | 4/1992 | Szeluga | 273/422 |
| 5,172,916 | 12/1992 | Puckett | 273/421 |

*Primary Examiner*—Paul E. Shapiro

[57] ABSTRACT

An arrowhead for use in the sport of archery hunting, which has a sharpened blade, pivotally mounted within a slot in the body of the arrowhead. The blade is held in a temporarily stationary position, centered within the slot, by a rubber o-ring, until such time as the arrowhead begins to penetrate the animal. Upon penetration the rubber o-ring slides rearward onto the arrow shaft, thus allowing the blade to pivot to either side of the arrowhead body. This design allows for decreased resistance when the blade strikes a hard surface within the body of the animal, thus the arrowhead achieves greater penetration into the body of the animal, causing a longer cut and therefore increased bleeding. This will result in a quicker and more humane kill.

6 Claims, 1 Drawing Sheet

ARCHERY HUNTING ARROWHEAD

BACKGROUND OF THE INVENTION

In the sport of archery hunting, one of the main concerns is how much penetration the arrowhead achieves upon striking the target. Since an arrowhead kills by causing bleeding, good penetration in the body of the animal being shot is of prime importance. In fact, full penetration of the arrowhead through the body of the animal is preferred.

When an arrowhead with a fixed blade design strikes a hard surface, such as bone or cartilage, within the body of the animal, the amount of penetration the arrowhead achieves is greatly diminished. This is due to the increased resistance caused by the fixed blade of the arrowhead pressing against a hard surface area, such as bone, within the body of the animal. On the other hand, if the blade of the arrowhead is allowed to move, or pivot, upon striking a hard surface, the amount of resistance the arrowhead encounters is greatly reduced, thus resulting in greater penetration of the arrowhead into the body of the animal.

Therefore, as far as the sport of archery is concerned, it is desirable to have an arrowhead with a moveable, or pivoting, blade design, in order to achieve a greater amount of penetration into the body of the animal, thereby creating a cut of greater length, thus creating a greater amount of bleeding.

REFERENCES CITED

The following references are of record in the file of this patent:

| UNITED STATES PATENTS | | |
|---|---|---|
| Number | Name | Date |
| 2,568,417 | Steinbacher | Sept. 18, 1951 |
| 4,166,619 | Bergmann | Sept. 4, 1979 |
| 3,036,395 | Nelson | May 29, 1962 |
| 3,138,383 | McKinzie | June 23, 1964 |

SUMMARY OF THE INVENTION

The present invention relates to an arrowhead, spearhead, or other projectile used in the sport of archery hunting, with a sharpened, pivotally mounted blade, temporarily held in a stationary position by a rubber o-ring. Upon penetration into the animal, friction causes the rubber o-ring to be pushed rearwardly onto the arrow shaft, thus allowing the blade to pivot, thereby providing an increase in penetration, due to a decrease in the resistance which occurs when the blade strikes a hard surface within the body of an animal.

It is an object of this invention to provide an arrowhead with a pivotally mounted blade design, allowing the arrowhead to penetrate deeper into the animal, thus achieving a quicker and more humane kill.

This and other objects will become apparent from the following description of the preferred embodiment.

DESCRIPTION OF THE PREFERRED EMBODIMENT

Figure 4:
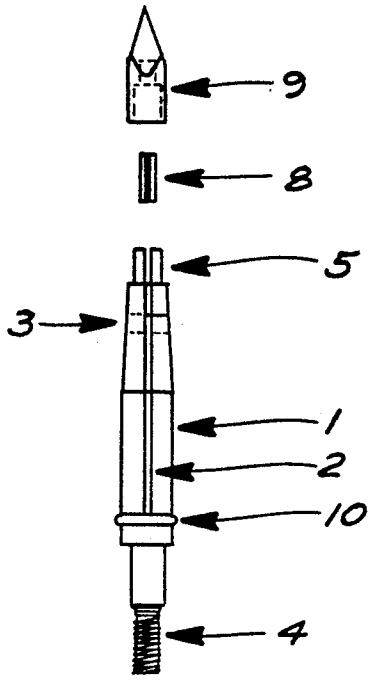
FIG. 4 is a side elevational view of the arrowhead body, showing how the sharpened tip and tip roll pin are fitted onto the flattened point of the arrowhead body. This drawing also shows how the blade retaining roll pin is fitted into the arrowhead body.

For the purposes of promoting an understanding of the principles of the invention, reference will now be made to the embodiment illustrated in the drawings.

Referring now to the drawing FIGS. 1–5. As shown in FIG. 4, the body (1) of the arrowhead is of a generally cylindrical shape, tapering to a flattened point (5), and containing a slot (2) cut through the entire width of the arrowhead body (1). Perpendicular to, and near the upper end of the slot (2), is a hole (3) which is also cut through the entire width of the arrowhead body (1), and is of such a size as to accommodate set screw (6). The threaded shaft (4) at the lower end of the arrowhead body (1), is provided to allow easy installation and/or removal from an arrow shaft.

Roll pin (8) is inserted into the upper portion of slot (2), and sharpened tip (9) is pressed onto the flattened point (5) of the arrowhead body (1). Roll pin (8) is held in place by the pressed fit of sharpened tip (9) over the flattened point (5) of the arrowhead body (1), and is provided to maintain the correct spacing of slot (2), as well as to add strength to the upper portion of the arrowhead body (1).

Figure 5:
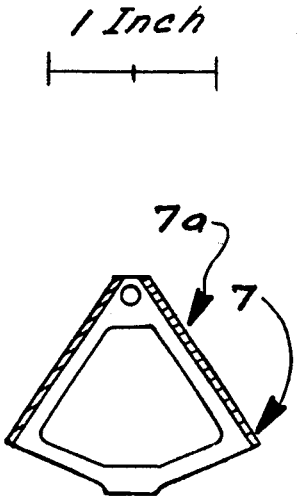
FIG. 5 is an elevational view of the blade removed from the remainder of the arrowhead.
Figure 3:
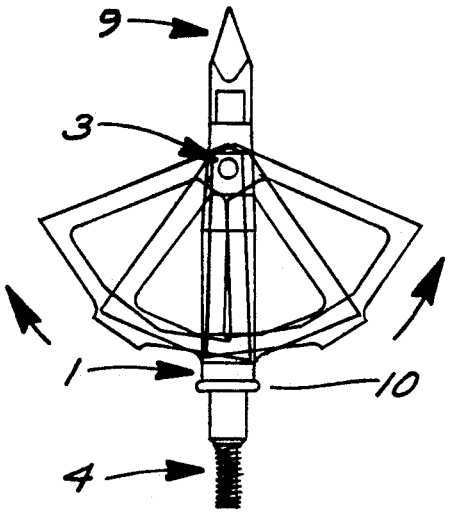
FIG. 3 is a front elevational view of the arrowhead, showing the blade in a temporarily stationary position, as well as showing the directional movement of the blade as it may pivot from one side to the other.
Figure 1:
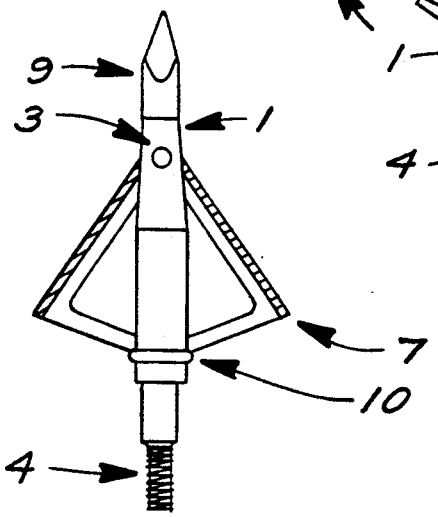
FIG. 1 is a front elevational view of the arrowhead, and shows the blade in a temporarily stationary position with the rubber o-ring in place on the body of the arrowhead.
Figure 2:
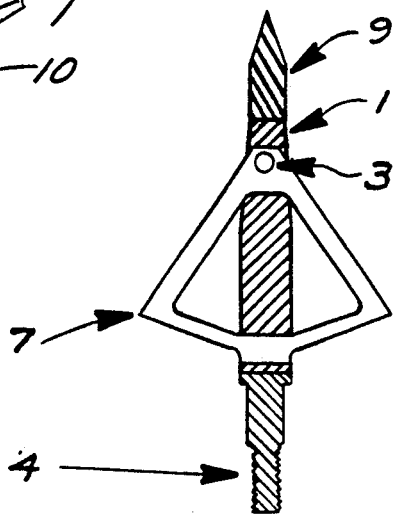
FIG. 2 is a longitudinal front sectional view through the arrowhead.

As shown in FIG. 5, the blade (7) is provided with sharpened edges (*7a*) blade (7) is pivotally secured within slot (2), as shown in FIG. 1, by means of set screw (6). The lower portion of blade (7) is held in this temporarily stationary position within body (1) by rubber o-ring (10), as indicated by FIG. 1. As the arrowhead penetrates the target, friction causes the rubber o-ring (10) to slide rearwardly onto the arrow shaft. This allows the blade (7) to pivot around set screw (6) to either side of body (1) along the path indicated in FIG. 3, thus providing greatly decreased resistance to any hard surface which the blade may contact as it penetrates the body of the animal.

The blade (7) is of such a size and shape as to fit within slot (2) of arrowhead body (1).

In operation, the arrowhead is installed on an arrow shaft, and the blade is held in a temporarily stationary position, centered within the slot of the arrowhead body, by the rubber o-ring. This design allows the arrowhead to achieve stable flight while also achieving greater penetration upon striking the body of the animal. As the arrowhead penetrates the animal, friction causes the rubber o-ring to slide rearwardly onto the arrow shaft, thus allowing the blade to pivot to either side of the arrowhead body. This provides a decrease in resistance to any hard surface which the blade may strike, thus achieving greater penetration into the body of the animal.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention and the scope of the claims are also desired to be protected.

The invention claimed is:

1. An arrowhead comprising in combination:

(a) a round body portion tapering upward to a flattened point, said body having a slot therethrough, said body having a hole therethrough near the upper end and perpendicular to said slot, and a threaded shaft at the lower end of said body portion;

(b) a sharpened tip installed on said flattened point of said body portion;

(c) a steel roll pin mounted within the upper portion of said slot in said body, over which said sharpened tip is installed;

(d) a blade pivotally mounted within said slot of said body portion;

(e) a set screw mounted in said hole near the upper end and perpendicular to said slot, around which said blade pivots;

(f) a rubber o-ring installed on said body in such a way as to hold said blade in a temporarily stationary position centered within said slot in said body.

2. The arrowhead of claim 1 wherein said blade is pivotally mounted within said slot in said body portion.

3. The arrowhead of claim 1 wherein said blade is removable and/or replaceable by removing and hence replacing said set screw from said hole which is near the upper end and perpendicular to said slot in said body portion.

4. The arrowhead of claim 1 wherein the entire exposed leading or forward edge of said blade contains a substantially sharpened cutting edge.

5. The arrowhead of claim 1 wherein said rubber o-ring is of such a size as to securely hold said blade in a temporarily stationary position centered within said slot in said body.

6. The arrowhead of claim 1 wherein said rubber o-ring is removable and/or replaceable from or on said body.

* * * * *